US012246213B2

(12) United States Patent
Rempel

(10) Patent No.: US 12,246,213 B2
(45) Date of Patent: Mar. 11, 2025

(54) EXERCISE SUPPORT BLOCK AND METHOD OF USE

(71) Applicant: Jeffrey James Quail, Winnipeg (CA)

(72) Inventor: Matthew John Rempel, Winnipeg (CA)

(73) Assignee: Jeffrey James Quail, Winnipeg (CA)

( * ) Notice: Subject to any disclaimer, the term of this patent is extended or adjusted under 35 U.S.C. 154(b) by 184 days.

(21) Appl. No.: 18/183,364

(22) Filed: Mar. 14, 2023

(65) Prior Publication Data

US 2024/0307732 A1 Sep. 19, 2024

(51) Int. Cl.
*A63B 21/00* (2006.01)

(52) U.S. Cl.
CPC .... *A63B 21/4033* (2015.10); *A63B 2225/093* (2013.01)

(58) Field of Classification Search
CPC ..... A63B 21/00047; A63B 21/4029; A63B 21/0023; A63B 21/0005; A63B 21/00054; A63B 21/4033; A63B 21/4037; A63B 21/4039; A63B 2225/093
See application file for complete search history.

(56) References Cited

U.S. PATENT DOCUMENTS 6,086,484 A * 7/2000 Uebelhor ..... A63B 53/0487 473/251
7,771,326 B1 * 8/2010 Anderson ..... A63B 25/02 623/28
10,470,581 B2 * 11/2019 Cimadamore ..... A47C 7/14
11,052,281 B2 * 7/2021 Saldate ..... A63B 21/0442
11,213,710 B2 * 1/2022 Kibby ..... A63B 21/4039
2007/0000447 A1 * 1/2007 Jakubowski ..... A01K 31/08 119/453
2013/0331746 A1 * 12/2013 Brown ..... A61H 1/00 601/46
2014/0274589 A1 * 9/2014 Harkins ..... A63B 21/4033 482/91
2015/0111661 A1 * 4/2015 Bennett ..... A63B 60/02 473/334
2015/0360074 A1 * 12/2015 Jung ..... A63B 21/0726 482/108
2017/0291055 A1 * 10/2017 Madion ..... A63B 23/0211
2018/0071567 A1 * 3/2018 Clark ..... A47G 27/0212
2021/0339098 A1 * 11/2021 Scott ..... A63B 53/0487
2024/0058987 A1 * 2/2024 Waugh ..... B28B 7/0097

* cited by examiner

*Primary Examiner* — Zachary T Moore
(74) *Attorney, Agent, or Firm* — Ryan W. Dupuis; Kyle R. Satterthwaite; Ade & Company Inc.

(57) ABSTRACT

The present invention relates to an exercise support block for supporting weight of a user above a supporting surface, for example the floor, during exercise such as yoga and the like. The support block has four major surfaces joined to define four apexes with a truncated surface being formed at each of the four apexes respectively whereby the support block has an overall truncated tetrahedral shape. The four truncated surfaces can support the user at four different heights relative to the floor by selecting a corresponding one of the four major surfaces to define the bottom of the block that is engaged on the floor.

9 Claims, 4 Drawing Sheets

EXERCISE SUPPORT BLOCK AND METHOD OF USE

FIELD OF THE INVENTION

The present invention relates to an exercise support block for supporting weight of a user above a supporting surface, for example a yoga block for supporting weight a yoga practitioner above the floor, and a method of using the exercise support block during exercise.

BACKGROUND

Yoga is a common form of exercise in which a practitioner of yoga supports their body in one or more body forms or postures commonly referred to as a yoga pose. To guide positioning of the body of the user during transition between poses or within a pose, it is known to use yoga blocks placed on the floor upon which the user places some of their weight. A conventional yoga block is a rectangular block having three diametrically opposing pairs of rectangular faces able to support a user thereon at three different heights. The broad rectangular faces of a conventional yoga block are difficult to grip in the hands of user in many poses.

SUMMARY OF THE INVENTION

According to one aspect of the invention there is provided an exercise support block for at least partially supporting weight of a user above a supporting surface during exercise, the exercise support block comprising:

a support body comprising (i) four major surfaces supported relative to one another to define a generally tetrahedral shape of the support body, and (ii) four apexes in which each apex is diametrically opposite to a respective opposed surface among the four major surfaces and being defined at a junction of three of the four major surfaces other than the respective opposed surface;

each apex of the support body defining a respective supporting height of the support body in which the supporting height of the apex is measured perpendicularly from the respective opposed surface to the apex for supporting the user thereon at the supporting height above the supporting surface when the respective opposed surface is engaged upon the supporting surface; and the supporting height of each apex being different than the supporting heights of each of the other apexes of the support body.

The unique shape of the support block described herein provides more adjustability to support a user at more heights than a conventional rectangular block that is limited to three supporting heights, while also providing a tapered apex for gripping in the hand of a user in each of the four supported heights that is more comfortable for gripping than the large, flat upper surface of a conventional rectangular support block.

Preferably each major surface comprises three major corner edges formed at an intersection of that major surface with the other major surfaces respectively.

Preferably the support body further comprises a truncated surface formed at each of the four apexes in which each truncated surface has a surface area which is smaller than a surface area of each of the four major surfaces.

Each truncated surface may be a flat or rounded surface in which at least a central portion of each truncated surface lies parallel to the respective opposed surface of the support body.

In the illustrated embodiment, each truncated surface is flat, is triangular in shape, and lies parallel to the respective opposed surface of the support body. In this instance, the four major surfaces and the truncated surfaces of the four apexes collectively define a truncated tetrahedron shape of the support body.

Preferably the support body is a solid body having a uniform material throughout. For example, the support body may be formed of a rigid foam material.

According to another aspect of the present invention there is provided a method of exercising, the method comprising:

providing an exercise support block comprising a support body comprising (i) four major surfaces supported relative to one another to define a generally tetrahedral shape of the support body, and (ii) four apexes in which each apex is diametrically opposite to a respective opposed surface among the four major surfaces and being defined at a junction of three of the four major surfaces other than the respective opposed surface;

supporting at least part of a weight of a user above a supporting surface at a first height by engaging a first surface among the major surfaces on the supporting surface such that a first apex among the four apexes is presented at the first height above the supporting surface to receive part of the user engaged thereon;

supporting at least part of the weight of the user above the supporting surface at a second height by engaging a second surface among the major surfaces on the supporting surface such that a second apex among the four apexes is presented at the second height above the supporting surface to receive part of the user engaged thereon, the second height being different than the first height;

supporting at least part of the weight of the user above the supporting surface at a third height by engaging a third surface among the major surfaces on the supporting surface such that a third apex among the four apexes is presented at the third height above the supporting surface to receive part of the user engaged thereon, the third height being different than the first height and the second height;

supporting at least part of the weight of the user above the supporting surface at a fourth height by engaging a fourth surface among the major surfaces on the supporting surface such that a fourth apex among the four apexes is presented at the fourth height above the supporting surface to receive part of the user engaged thereon, the fourth height being different than the first height, the second height and the third height.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 2:
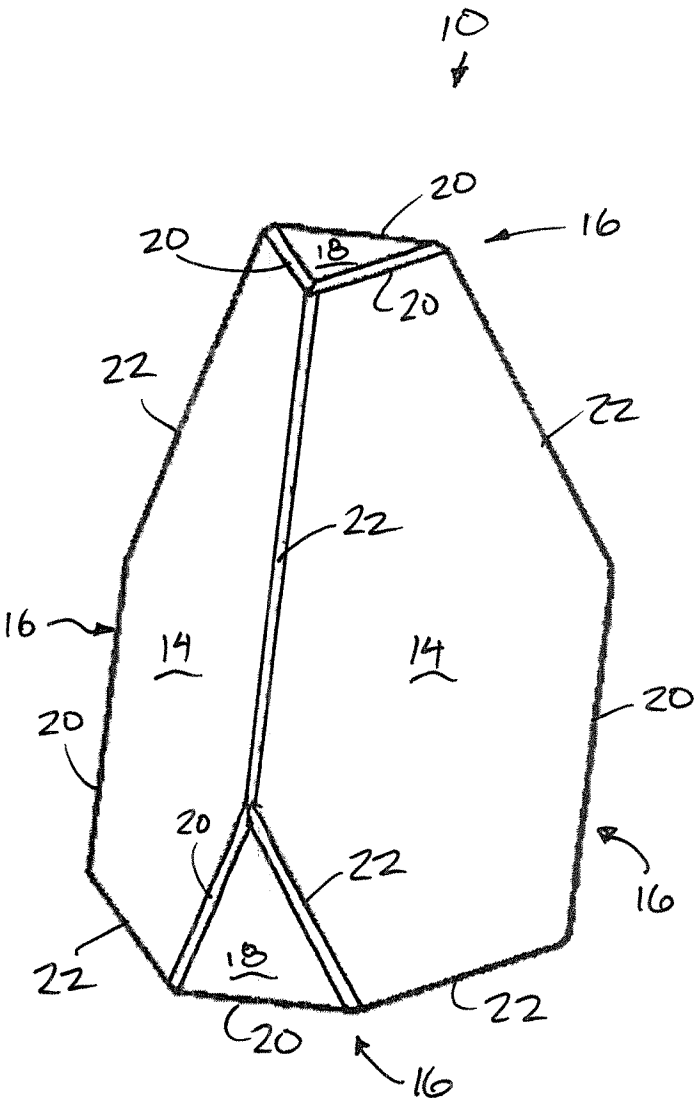
FIGS. 1 and 2 are perspective views of the exercise support block shown supported in a first orientation.
Figure 1:
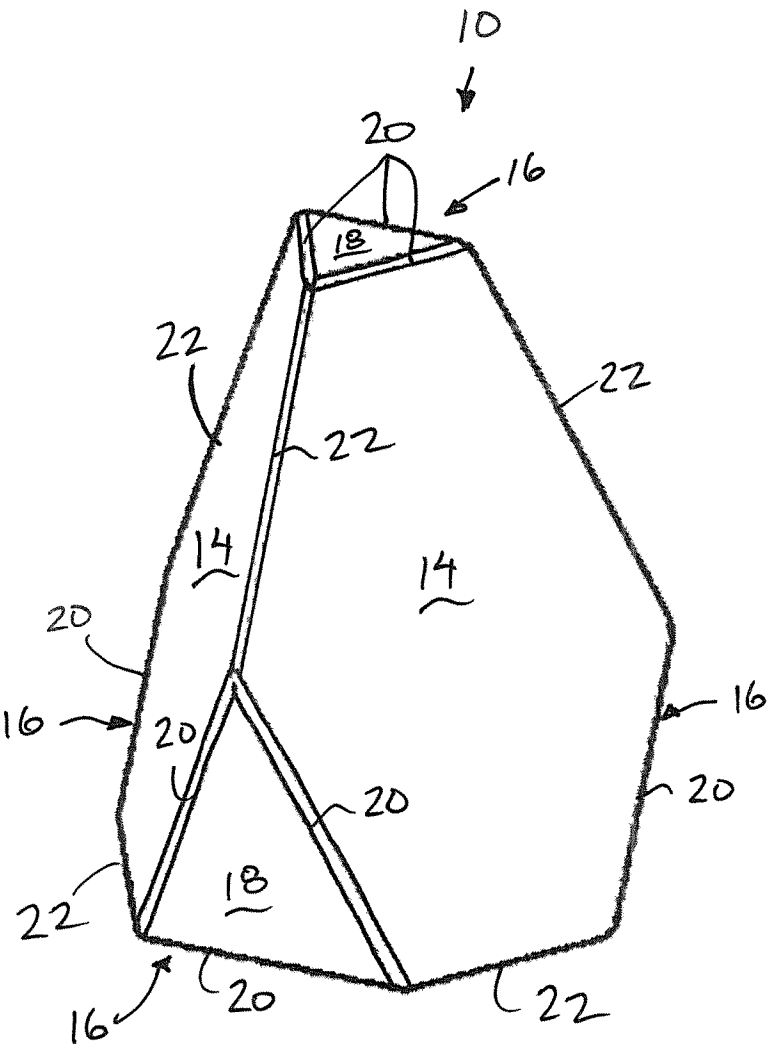
Figure 4:
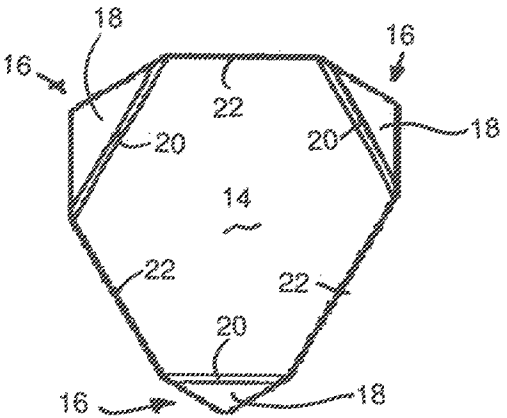
FIG. 4 is a bottom view of the exercise support block shown in the first orientation of FIG. 1.
Figure 3:
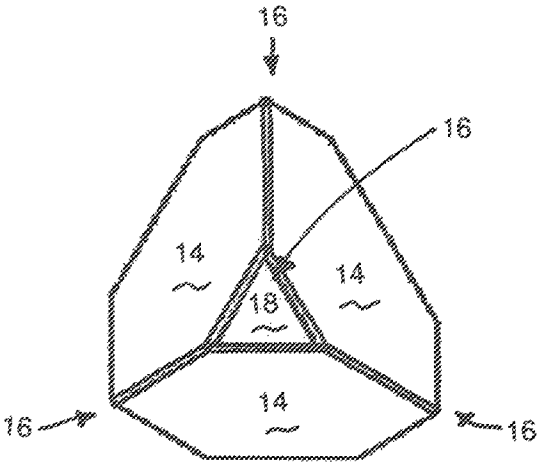
FIG. 3 is a top plan view of the exercise support block shown in the first orientation of FIG. 1.
Figure 8:
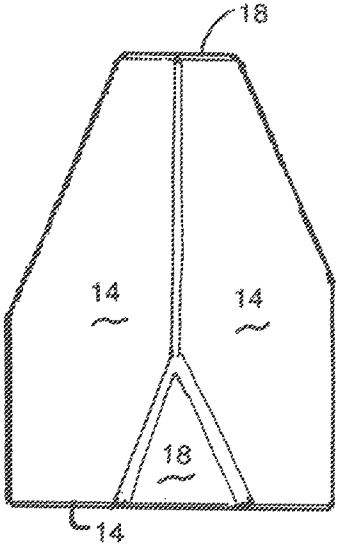
FIG. 8 is a rear elevational view of the exercise support block according to FIG. 5.
Figure 7:
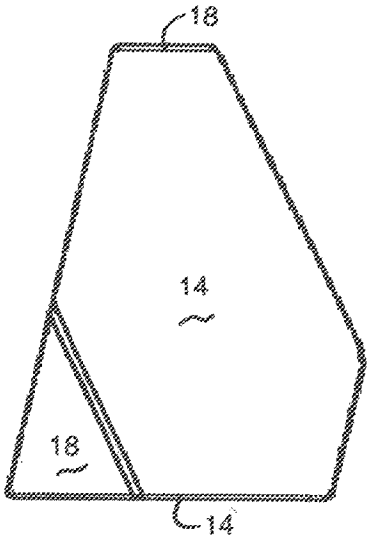
FIGS. 6 and 7 are left-side and right-side elevational views respectively of the exercise support block according to FIG. 5.
Figure 5:
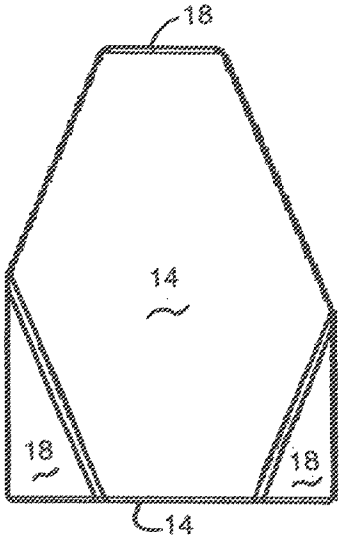
FIG. 5 is a front elevational view of the exercise support block shown in the first orientation of FIG. 1.
Figure 6:
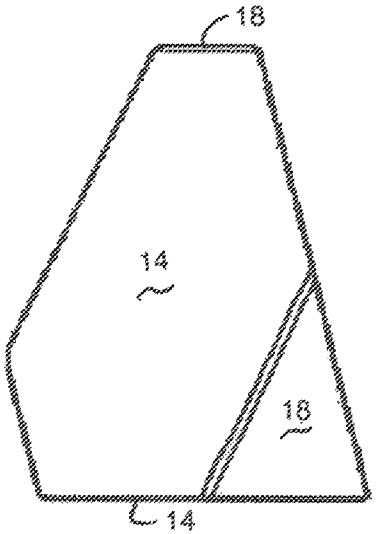

Referring to the accompanying figures there is illustrated an exercise support block generally illustrated by reference numeral 10.

The exercise support block 10 comprises a single, unitary support body which is solid and formed of a rigid foam material that is uniform and continuous throughout the block. The support body of the support block is able to support some or all of the weight of a user thereon above a supporting surface such as the floor 12 upon which the block 10 is engaged. The exercise support block 10 is particularly suited for supporting part of the weight of a user thereon during a yoga pose while the user performs yoga exercises for example.

The support body forming the block 10 generally includes (i) four major surfaces 14 arranged in a tetrahedral form to define the general tetrahedron shape of the support body that includes four corner apexes 16, and (ii) four truncated surfaces 18 at the four apexes 16 respectively.

Each of the truncated surfaces 18 is a flat surface which is triangular in shape so as to lie parallel to a respective one of the four major surfaces 14 that lies at the diametrically opposite side of the support body. Each truncated surface 18 has a surface area which is smaller than the surface area of the smallest one of the four major surfaces 14. Each apex 16 is formed at the junction of three of the major surfaces 14 such that the truncated surface 18 at the resulting apex has a triangular shape with the three side edges of the triangular truncated surface corresponding to three minor corner edges 20 lying at the junction of the truncated surface 18 with each of the three adjacent major surfaces 14.

Each of the major surfaces 14 is also a flat surface defining a six-sided polygon. Three of the side edges of each major surface 14 are defined by the minor corner edges 20 where the major surface 14 intersects three of the truncated surfaces 18 at the corresponding apexes of the body. The remaining three side edges of each major surface 14 are formed by major corner edges 22 where the major surface 14 intersects the three other major surfaces 14 of the support body.

The resulting overall shape of the support body is that of a non-regular or non-uniform, truncated tetrahedron having four major surfaces 14 which are irregular hexagons and four truncated surfaces 18 at the four apexes which are triangular in shape. The irregular hexagons provide the ability of the support body to present four different supporting heights of the block depending upon which of the four major surfaces 14 is located at the bottom to be engaged upon the floor as described in the following.

Figure 15:
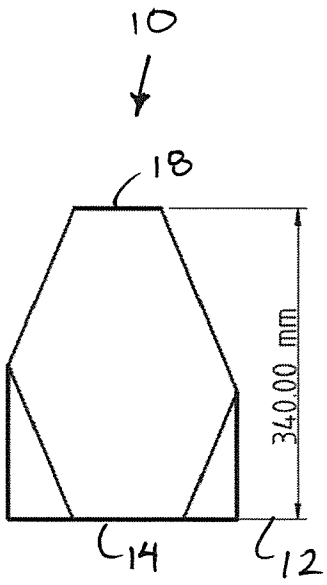
FIG. 15 is a front elevational view of the exercise support block in the first orientation according to FIG. 5 illustrating a first supporting height of the support block relative to the floor.

In a first orientation of the support block shown in FIGS. 1 through 8, a first major surface among the major surfaces 14 is located at the bottom to be engaged on the floor 12 so that a corresponding first one of the apexes 16 is located at the top to support weight of the user on the truncated surface 18 at the top of the block at a first supported height above the floor 12 as shown in FIG. 15.

Figure 9:
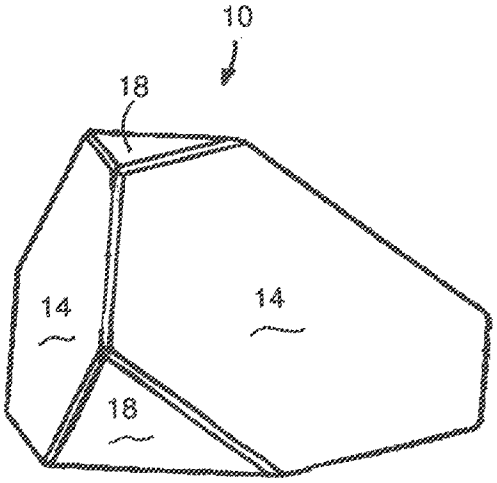
FIGS. 9 and 10 are perspective views of the exercise support block shown supported in a second orientation.
Figure 10:
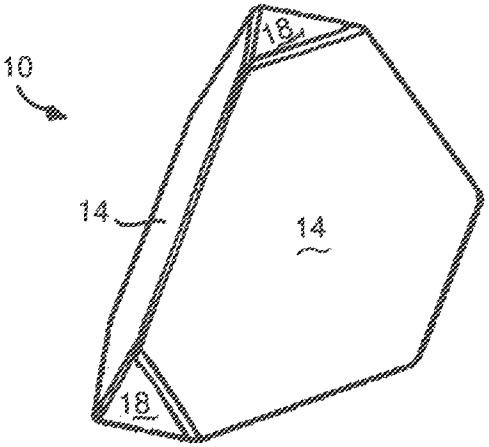
Figure 16:
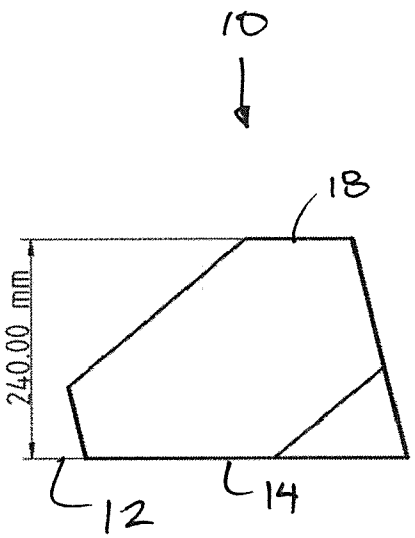
FIG. 16 is a front elevational view of the exercise support block in the second orientation according to FIGS. 9 and 10 illustrating a second supporting height of the support block relative to the floor.

In a second orientation of the support block shown in FIGS. 9 and 10, a second major surface among the major surfaces 14 is located at the bottom to be engaged on the floor 12 so that a corresponding second one of the apexes 16 is located at the top to support weight of the user on the truncated surface 18 at the top of the block at a second supported height above the floor 12 as shown in FIG. 16.

Figure 11:
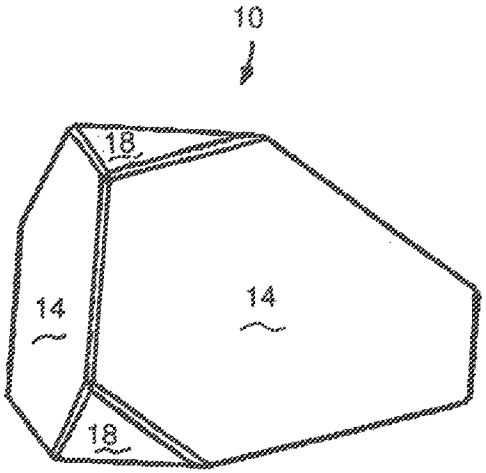
FIGS. 11 and 12 are perspective views of the exercise support block shown supported in a third orientation.
Figure 12:
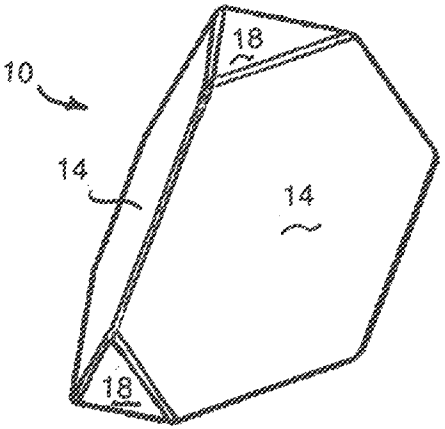
Figure 17:
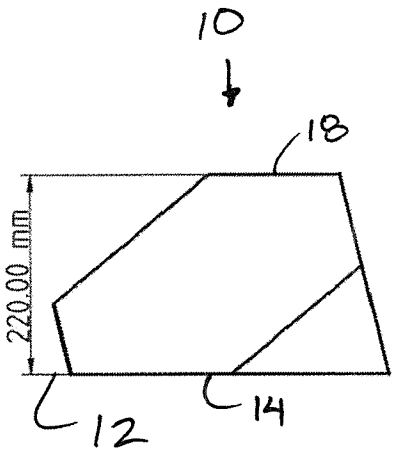
FIG. 17 is a front elevational view of the exercise support block in the third orientation according to FIGS. 11 and 12 illustrating a third supporting height of the support block relative to the floor.

In a third orientation of the support block shown in FIGS. 11 and 12, a third major surface among the major surfaces 14 is located at the bottom to be engaged on the floor 12 so that a corresponding third one of the apexes 16 is located at the top to support weight of the user on the truncated surface 18 at the top of the block at a third supported height above the floor 12 as shown in FIG. 17.

Figure 13:
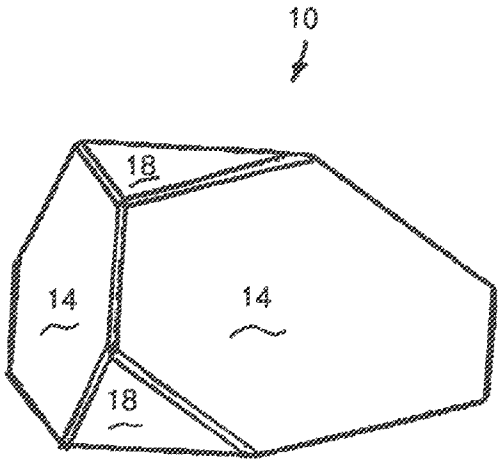
FIGS. 13 and 14 are perspective views of the exercise support block shown supported in a fourth orientation.
Figure 14:
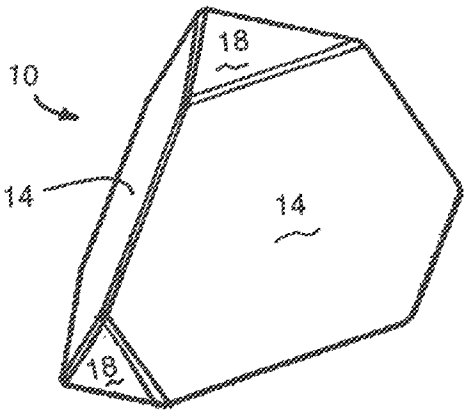
Figure 18:
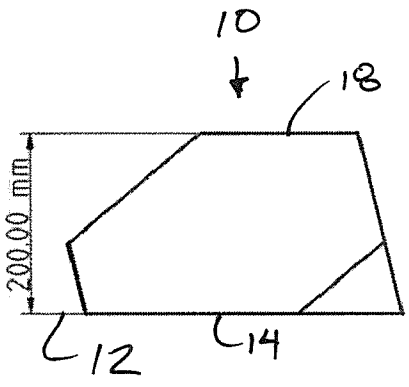
FIG. 18 is a front elevational view of the exercise support block in the fourth orientation according to FIGS. 13 and 14 illustrating a fourth supporting height of the support block relative to the floor.

In a fourth orientation of the support block shown in FIGS. 13 and 14, a fourth major surface among the major surfaces 14 is located at the bottom to be engaged on the floor 12 so that a corresponding fourth one of the apexes 16 is located at the top to support weight of the user on the truncated surface 18 at the top of the block at a fourth supported height above the floor 12 as shown in FIG. 18.

In use, while performing yoga poses and the like for example, the user supports part of their weight on the block engaged on the floor during exercise. The user selects the desired supporting height of the block by changing the orientation of the block between the four different orientations of the block described above. For each selected orientation, the user places the corresponding major surface 14 at the bottom on the floor so that the diametrically opposed truncated surface 18 at the respective apex 16 is located at the top of the block. The truncated surface at the top receives weight of the user thereon to support the weight spaced above the floor by the corresponding selected height of the block. The tapered shape of the block formed at the apex at the top of the block in each of the selected orientations provide a comfortable grip for the hand of the user for poses where the hand of the user is placed on top of the block.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. An exercise support block for at least partially supporting weight of a user above a supporting surface during exercise, the exercise support block comprising:

a support body comprising (i) four major surfaces supported relative to one another to define a generally tetrahedral shape of the support body, and (ii) four apexes in which each apex is diametrically opposite to a respective opposed surface among the four major surfaces and being defined at a junction of three of the four major surfaces other than the respective opposed surface;

each apex of the support body defining a respective supporting height of the support body in which the supporting height of the apex is measured perpendicularly from the respective opposed surface to the apex for supporting the user thereon at the supporting height above the supporting surface when the respective opposed surface is engaged upon the supporting surface; and the supporting height of each apex being different than the supporting heights of each of the other apexes of the support body.

2. The exercise support block according to claim 1 wherein each of the major surfaces comprises three major corner edges formed at an intersection of that major surface with the other major surfaces respectively.

3. The exercise support block according to claim 1 wherein the support body further comprises a truncated surface formed at each of the four apexes, each truncated surface having a surface area which is smaller than a surface area of each of the four major surfaces.

4. The exercise support block according to claim 3 wherein at least a central portion of each truncated surface lies parallel to the respective opposed surface of the support body.

5. The exercise support block according to claim 3 wherein each truncated surface is flat, each truncated surface is triangular in shape, and each truncated surface lies parallel to the respective opposed surface of the support body.

6. The exercise support block according to claim 5 wherein the four major surfaces and the truncated surfaces of the four apexes collectively define a truncated tetrahedron shape of the support body.

7. The exercise support block according to claim 1 wherein the support body is a solid body having a uniform material throughout.

8. The exercise support block according to claim 1 wherein the support body is formed of a rigid foam material.

9. A method of exercising, the method comprising:

providing an exercise support block comprising a support body comprising (i) four major surfaces supported relative to one another to define a tetrahedral shaped body of the support body, and (ii) four apexes in which each apex is diametrically opposite to a respective opposed surface among the four major surfaces and being defined at a junction of three of the four major surfaces other than the respective opposed surface;

supporting at least part of a weight of a user above a supporting surface at a first height by engaging a first surface among the major surfaces on the supporting surface such that a first apex among the four apexes is presented at the first height above the supporting surface to receive part of the user engaged thereon;

supporting at least part of the weight of the user above the supporting surface at a second height by engaging a second surface among the major surfaces on the supporting surface such that a second apex among the four apexes is presented at the second height above the supporting surface to receive part of the user engaged thereon, the second height being different than the first height;

supporting at least part of the weight of the user above the supporting surface at a third height by engaging a third surface among the major surfaces on the supporting surface such that a third apex among the four apexes is presented at the third height above the supporting surface to receive part of the user engaged thereon, the third height being different than the first height and the second height;

supporting at least part of the weight of the user above the supporting surface at a fourth height by engaging a fourth surface among the major surfaces on the supporting surface such that a fourth apex among the four apexes is presented at the fourth height above the supporting surface to receive part of the user engaged thereon, the fourth height being different than the first height, the second height and the third height.

* * * * *